United States Patent [19]

Jones

[11] 4,319,401

[45] Mar. 16, 1982

[54] REGISTERED GUIDE FOR GRAPHIC REPRODUCTION

[76] Inventor: Leon W. Jones, 6933 Folsom Oaks Ct., Roseville, Calif. 95678

[21] Appl. No.: 134,873

[22] Filed: Mar. 28, 1980

[51] Int. Cl.[3] ..... B43L 13/20

[52] U.S. Cl. ..... 33/174 B; 434/87

[58] Field of Search ..... 33/1 B, 174 B; 434/85, 434/87; 275/157 R, 157 D

[56] References Cited

U.S. PATENT DOCUMENTS

| | | | |
|---|---|---|---|
| 557,895 | 4/1896 | Saunders | 33/174 B X |
| 1,552,406 | 9/1925 | Akerbladh | 434/88 |
| 3,633,286 | 1/1972 | Maurer | 33/174 B X |

FOREIGN PATENT DOCUMENTS

| | | | |
|---|---|---|---|
| 566710 | 11/1923 | France | 33/174 B |
| 6411047 | 3/1966 | Netherlands | 434/87 |
| 746298 | 3/1956 | United Kingdom | 33/174 B |

*Primary Examiner*—Harry N. Haroian

*Attorney, Agent, or Firm*—William H. Maxwell

[57] ABSTRACT

A graphic reproduction guide for the enlargement of realistic images from a relatively small die cut planar element comprised of sequentially positionable registrations and distinct groups of delineation features sequentially applicable to correspondingly identified registrated positions for the application of graphic lines and/or points to cover a surface in multiple areas larger than the device.

12 Claims, 9 Drawing Figures

REGISTERED GUIDE FOR GRAPHIC REPRODUCTION

BACKGROUND

Realism in enlarged graphic representations of a persons' image, for example, is difficult to obtain, and accordingly the prior art provides stencils, pantographs and like cumbersome apparatus commensurate with the size of the image to be reproduced. Experience and talent has been relied upon to a great extent, and aids for those who are not so experienced and talented are rather complex and expensive. Therefore, it is a general object of this invention to provide means whereby a person with little or no experience and talent is enabled to reproduce graphic images with realism.

The graphic image reproduction of the prior art has been limited to the full size of the stencil, or pantograph or such apparatus corresponding in size with the enlarged reproduction. However, with the present invention it is an object to divide the magnitude of the graphic art at least one or more times, and preferably a multiplicity of times. With the present invention a graphic guide is shiftable according to self applied registration, whereby multiple positions thereof are usefully employed in transferring the graphic image onto a surface. In practice, the movement of this graphic guide is linear, or rectilinear and/or rotary, as will be described in its several forms.

Prior art delineation by means of stencil, pantograph and the like, is difficult when the enlargement is great; as applied to walls, floors and to large canvases and windows etc. By reducing the size of the apparatus, by employing the aforesaid division in magnitude of the physical device, and by sequentially shifting to determined registered positions, multiple delineation is applied. Accordingly, it is an object herein to provide distinct groups of image points and/or lines, each of which is identifiable according to the requirements of the graphic image to be reproduced.

It is an object to provide an inexpensive finished paperboard product, or of like material, having self executing features with high tolerance for error, yet providing a high degree of excellence, not necessarily related to the operators' experience or talents. An ease of execution heretofore unavailable is provided together with superior results; and all of which offers vast economic and creative opportunities heretofore unavailable in marketing as related to premiums, promotional items and displays of all kinds. Size limitations are avoided, this graphic guide being provided in a small package form which is unfolded to reproduce art images many times its size, all as circumstances require.

SUMMARY OF THE INVENTION

This invention relates to graphic reproduction in the form of enlarged images realistic in their representation of known persons or things. Perfection is not necessarily a requisite, inasmuch as the graphic guide herein disclosed is forgiving and is devoid of criticality. Imperfection is inherently compensated for, just so long as the delineation produced thereby is substantially completed. When the delineation is complete, then the image can be painted in as required according to the color scheme which is most appropriate or specified. In practice for example, the image to be reproduced can be that of a recording artist and the graphic guide in the form of a die cut cardboard sheet furnished as an insert to be included in the folder and carried in the pocket of a record album or the like. The die cut guide can be folded within the diameter of the record, and when it is unfolded will extend several feet or more. And in accordance with this invention the guide multiplies the image size when operated, as will be described. The delineation of the image is by means of numbered points or lines and/or locus positions along which the features of the image are marked and then drawn. These delineating features are holes or slots and preferably numbered tabs. A feature of this invention is that each numbered group of holes, slots or tabs is related to a registered position of the guide, the registration at sequential positions being determined by die cut features arranged to be sequentially registerable.

The foregoing and other various objects and features of this invention will be apparent and fully understood from the following detailed description of the typical preferred forms and applications thereof, throughout which description reference is made to the accompanying drawings.

Figure 7:
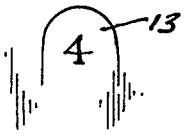
FIG. 7 is an enlarged view of the preferred form of delineation means, an identified tab.
Figure 8:
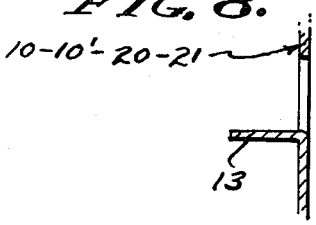

And, FIG. 8 is a sectional view of the tab shown in FIG. 7 after it has been bent out of the plane of the body member to establish an opening therein.

PREFERRED EMBODIMENT

Figure 1A:
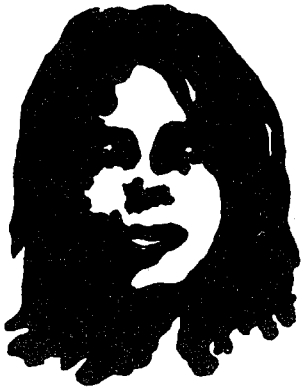
FIG. 1 is a view showing the sequential operation of the rotary form of graphic reproduction guide, as it is used to reproduce the complete image shown pictorially in FIG. 1*a*.
Figure 1:
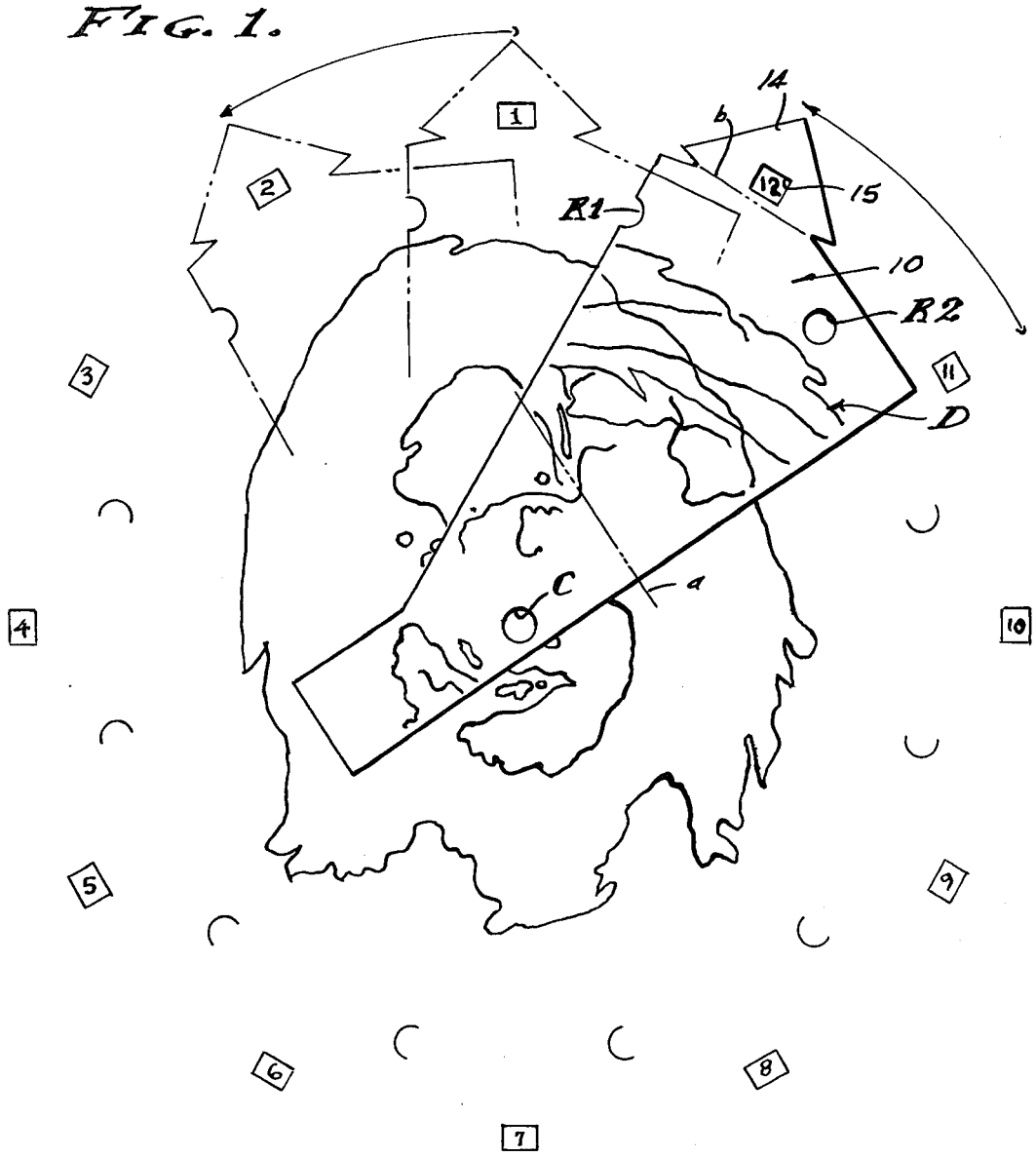
Figure 2:
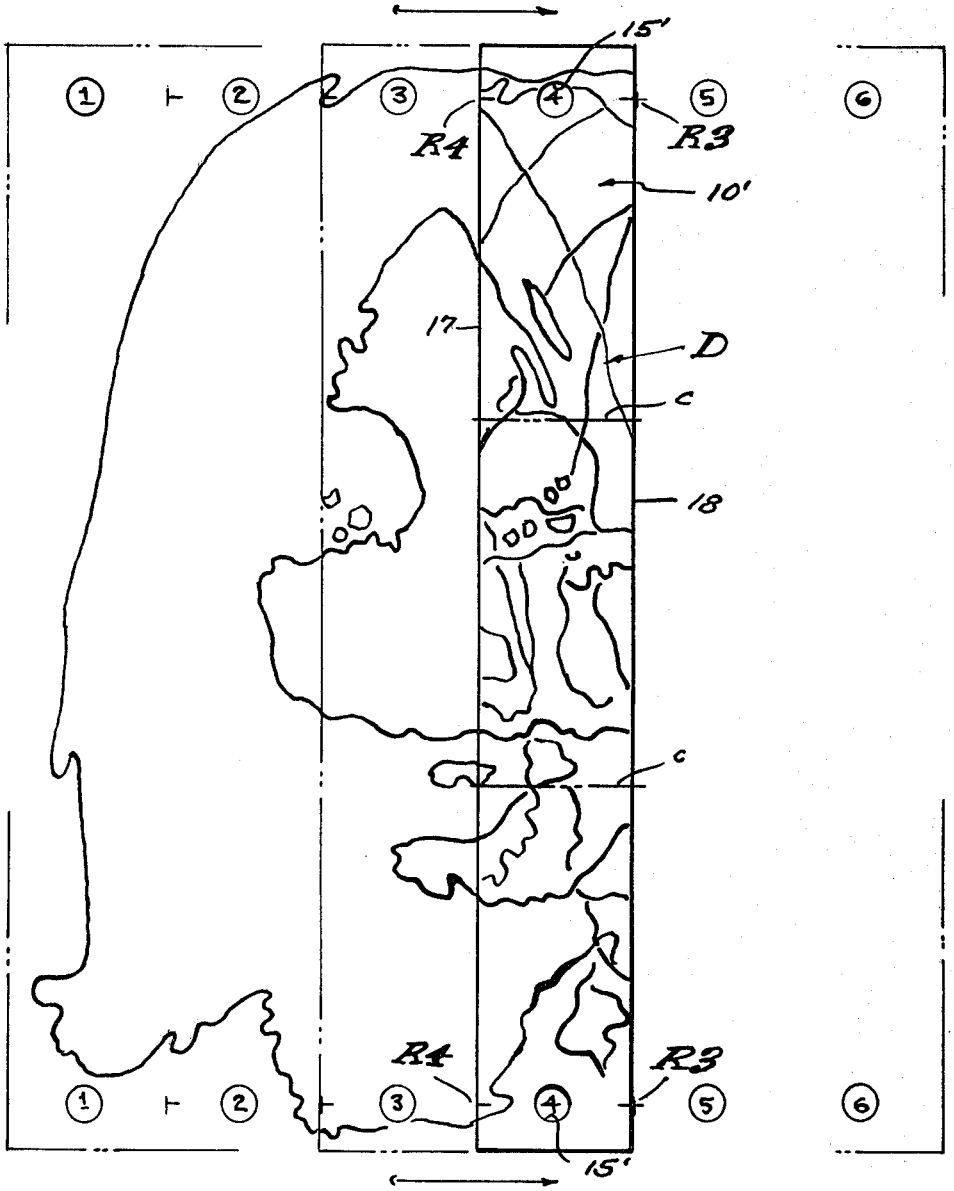
FIG. 2 is a view of the linear form of graphic reproduction guide, as it is used to reproduce said image, partially completed.
Figure 4:
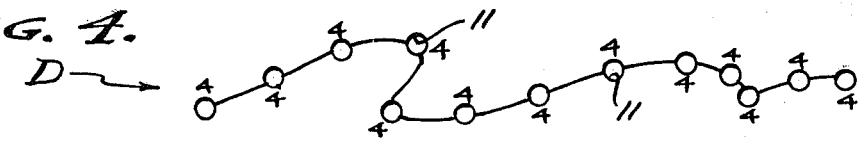
FIGS. 4, 5 and 6 are enlarged detailed views, each showing a portion of the image delineation removed to illustrate the three forms of delineation means disclosed herein.
Figure 5:
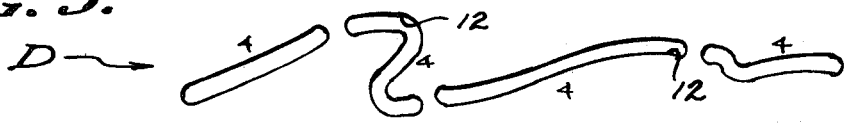
Figure 3:
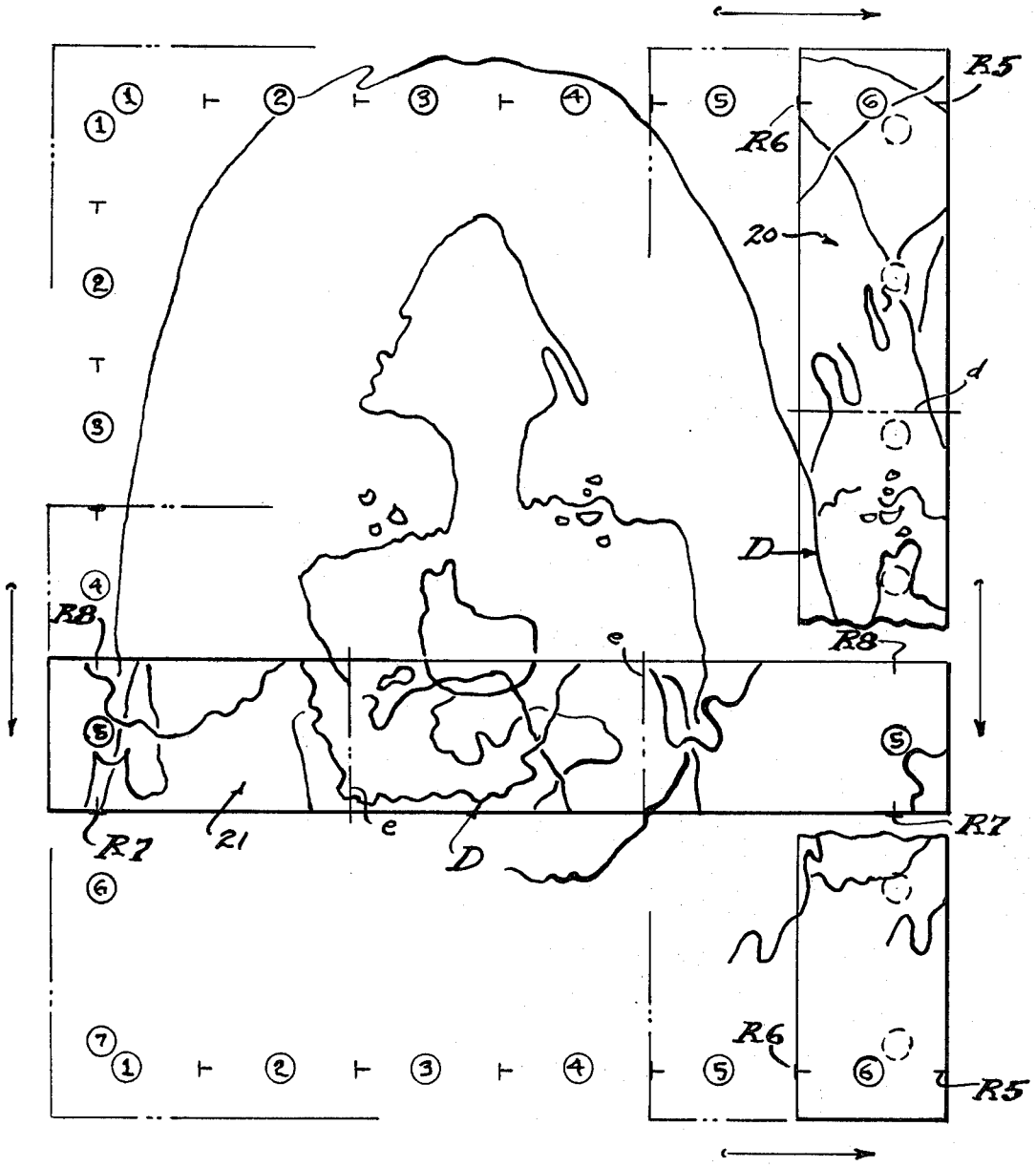
FIG. 3 is a view of the rectilinear form of graphic reproduction guide, as it is used to reproduce said image, partially completed.
Figure 6:
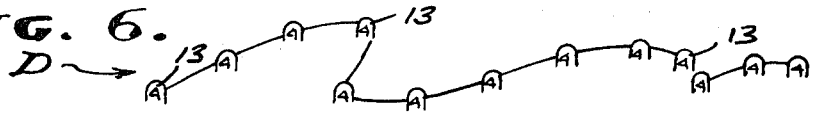

Three forms of the graphic reproduction guide are disclosed herein, the rotating form of FIG. 1, the linear form of FIG. 2, and the rectilinear form of FIG. 3. All three forms have basic features in common which include embodiment in a planar body member 10 in which sequential registration is related to a corresponding delineation means D in the form of a series of holes 11, or slots 12, or a series of tabs 13. In carrying out this invention, there is an identified delineation means D for each registered position of the body member 10, and accordingly it is important to identify the delineating holes, slots or tabs with the registered positions where they are to be employed to transfer image points or lines onto a work surface. In practice, the register positions are consecutively numbered, for example "1" to "12" in FIG. 1, in which case the groups of tabs 13 die-cut in the body member 10 are correspondingly numbered (see FIGS. 6 and 7), namely the outline shown as a series of holes in FIG. 4, or a slot in FIG. 5, or a series of tabs in FIG. 6. Any one hole, or slot or tab can be designated as associated with one or more registered positions. In practice, the tabs are bent out as shown in FIG. 8 so that a mark can be applied through the opening established thereby. It is a simple matter to trace through the slot 12, or to join the markings made through a series of openings 11 or tab 13 openings; following a pictorial example as shown in FIG. 1*a*.

Referring now to the rotating form of FIG. 1 of the drawings, the body member 10 is shown in its unfolded planar form, having been opened up along a single fold line a. Additionally, there is a reference point 14 that can be unfolded along a second fold line b. The configuration of body member 10 can vary as required, that shown being chosen for a particular format revealed thereby for other purposes related to advertising and promotion. Fundamentally, however, the body member 10 is elongated and radially disposed from a center register C which is shown coincidental with the center of the graphic art or image to be reproduced. As shown, the center C is a registration opening of round concentric form adapted to be located coincident with a similar mark made therethrough upon the work surface to which the reproduction is to be applied. Spaced radially from the center C in alignment with the reference pointer 14, there is a pair of circumferentially spaced register openings R1 and R2, shown equidistant from a radial line to the pointer 14. The register features are at least partial openings, and preferably of arcuate or circular form in each instance, shown as the same in size and/or of the same radius. The delineation means D are angularly displaced about the center register C, at various radials as circumstances require. As shown the body member 10 continues through the center so that the delineation means can be applied at the other side of the center C as desired. A window 15 is provided through the pointer 14, in order to apply numerical registration registrations "1" to "12" onto the work surface. In FIG. 1 the delineation means D is shown exclusively as lines, it being understood that said means can be in the form of a series of holes 11, slots 12, or a series of tabs 13, all as hereinabove described.

Operation of the graphic guide of FIG. 1 is as follows: The center register C is placed concentric with a chosen center for the image or portion thereof to be reproduced, and the pointer 14 disposed vertically for an upright reproduction. The reference "1" is applied through the window 15, whereupon all delineation means holes, slots or tab openings identified as group "1" are marked through said delineation openings and onto the work surface. Assuming then that sequential registration is to progress counterclockwise as shown, register opening R1 in the direction of rotation is marked through and onto the work surface. Register opening R2 is also marked, following which the body member 10 is revolved or rotated on center C until register R2 coincides with the mark previously made upon the work surface through register opening R1, all of which predetermines registration position "2"; whereupon the reference "2" is applied through window 15 and all delineation means holes, slots or tab openings identified as group "2" are marked through said delineation openings and onto the work surface; and so on until registration position "12" is finally completed and coincides with position "1" marking of register R2. The markings and/or lines are then joined and the graphic art completed according to the pictorial example.

Referring now to the linear form of FIG. 2 of the drawings, the body 10' is shown in its unfolded planar form, having been opened along multiple fold lines c. The configuration of body member 10' is that of a narrow elongated rectangle adapted to be disposed horizontally or vertically and maintained in either disposition as it is shifted sequentially from one registered position to the next. As shown, the body member 10' is vertically disposed and shiftable into six identifiable positions as predetermined by spaced register marks R3 and R4 made at or in the opposite vertical (or horizontal) edges 17 and 18. In practice, the register marks R3 and R4 are located near the upper and lower ends of the body member 10', the edges 17 and 18 of which are parallel, and all for the purpose of sequentially shifting the body member 10' into identifiable registered positions. One or more windows 15' are provided through an otherwise unused portion of the body member in order to apply numerical registration references onto the work surface. In FIG. 2 the delineation means D is shown the same as in FIG. 1, as a series of holes 11, slots 12, or a series of tabs 13, all as hereinabove described.

Operation of the graphic guide of FIG. 2 is as follows: The body member 10' is positioned vertically (or horizontally and all as required by the graphic art involved) at one side of the image area, for example to the left in which case subsequent registration occurs to the right in six increments, for example, as shown. The reference "1" is applied through the window 15', whereupon all delineation means holes, slots or tab openings identified as group "1" are marked through said delineation openings and onto the work surface. Spaced register markings are then made onto the work surface at each register mark R3, said marks being made uniformly close to the right hand leading edge 18, following which the body member 10' is shifted to the right until the markings R4 at the left hand trailing edge 17 coincide with the spaced register markings R3, all of which predetermines registration position "2"; whereupon the reference "2" is applied through window 15' and all delineation means holes, slots or tab openings identified as group "2" are marked through said delineation openings and onto the work surface; and so on until registration position "6" is finally completed. The markings and/or lines are then joined and the graphic art completed according to the pictorial example.

Referring now to the rectilinear form of FIG. 3 of the drawings, bodies 20 and 21 are shown in their unfolded planar forms, having been opened along multiple fold lines d and e. The configurations of body members 20 and 21 are that of narrow elongated rectangles adapted to be disposed vertically and horizontally respectively. As shown, each body member is shiftable into six or seven identifiable positions as predetermined by spaced register members R5 and R6, and by spaced register marks R7 and R8, located at opposite parallel sides of the body members 20 and 21; the same as above described with the body member 10'. With this dual member form of the invention, vertically disposed image features are advantageously incorporated in the vertical body member 20, while horizontally disposed image features are advantageously incorporated in the horizontal body member 21. In each instance the delineation features are in the form of a series of holes 11, slots 12, or a series of tabs 13, all as hereinabove described.

Operation of the graphic guide of FIG. 3 is the same as that of the form of FIG. 2 above described. However, guide 20 is operated vertically through registered positions from left to right, while guide 21 is operated horizontally through registered positions from top to bottom.

From the foregoing it will be seen that the delineation means D, preferably the tabs 13, are sequentially shifted and identified as groups of openings through which guide markings are exactly placed onto the work surface. Sequential registration is predetermined by shifting the body members of the guide or guides into positions coincidental with registration marks previously located thereby. For each registered position, means is provided for recording a reference thereof, and the groups of delineation openings (holes, slots or tab openings) are numerically identified. It is a simple matter therefore, to lift or bend out the identifiable tabs and mark the work surface through the openings formed thereby, according to the mode of operation hereinabove described, thereby reproducing the exact image which is die cut into the body member in the form of delineation means D. This guide can then be folded and stored for subsequent reuse, as circumstances require.

Having described only the typical preferred forms and applications of my invention, I do not wish to be limited or restricted to the specific details herein set forth, but wish to reserve to myself any modifications or variations that may appear to those skilled in the art as set forth with the limits of the following claims.

I claim:

1. A guide for the reproduction of an image onto a work surface and comprised of a shiftable elongated body member of planar form smaller in area than the image to be reproduced and adapted to be moved over said work surface and with spaced registers at opposite sides thereof, one side register for the application of a registration marking onto the work surface and the other side register for registration with said register marking when positioning the body member sequentially from one registered position to the other, there being a multiplicity of delineation means with marking openings through the body member and each identified with a registered position of the body member, the delineation means markings producing the image upon the work surface multiplied from the body member size by the number of registered positions.

2. The image reproducing guide as set forth in claim 1, wherein the body member is rotatably positioned, there being a center register at one end thereof about which the body member is sequentially positioned from one side register to the other at the other end thereof.

3. The image reproducing guide as set forth in claim 1, wherein a single body member is linearly positioned, there being spaced registers at opposite parallel sides of the body member.

4. The image reproducing guide as set forth in claim 1, wherein a single body member of rectangular form is linearly positioned, there being spaced registers at opposite ends of and at opposite parallel sides of the body member.

5. The image reproducing guide as set forth in claim 1, wherein a pair of body members are rectilinearly positioned in normally related directions of movement, there being spaced registers at opposite parallel sides of each of said body members for independent sequential registered positioning.

6. The image reproducing guide as set forth in claim 1, wherein a pair of body members of rectangular form are rectilinearly positioned in normally related directions of movement, there being spaced registers at opposite ends of and at opposite parallel sides of the body members for independent sequential registered positioning.

7. The image reproducing guide as set forth in any one of claims 1 through 6, wherein a window through the body member enables marking of the work surface with an identification corresponding to each registered position and delineation means associated therewith.

8. The image reproducing guide as set forth in claim 1, wherein each of the delineation means is comprised of a series of identified openings through the body member.

9. The image reproducing guide as set forth in claim 1, wherein each of the delineation means is comprised of an identified slot through the body member.

10. The image reproducing guide as set forth in claim 1, wherein each of the delineation means is comprised of a series of identified slots through the body member.

11. The image reproducing guide as set forth in claim 1, wherein each of the delineation means is comprised of a series of identified tabs to be bent from the plane of the body member to establish marking openings therethrough.

12. The image reproducing guide as set forth in claim 1, wherein the body member is rotatable positioned, there being a center register at one end thereof about which the body member is sequentially positioned from one side register to the other at the other end thereof, and wherein the delineation means are angularly displaced radially about the said center register.

* * * * *